United States Patent [19]

Klee et al.

[11] Patent Number: 4,524,548

[45] Date of Patent: Jun. 25, 1985

[54] CONTINUOUS DEFLASHING SYSTEM

[75] Inventors: David J. Klee, Emmanus; Donald J. Ehnot, Coopersburg, both of Pa.

[73] Assignee: Air Products and Chemicals, Inc., Allentown, Pa.

[21] Appl. No.: 487,679

[22] Filed: Apr. 22, 1983

[51] Int. Cl.[3] ..... B24C 1/00

[52] U.S. Cl. ..... 51/322; 51/319; 51/418

[58] Field of Search ..... 51/321, 322, 418, 317, 51/318, 319, 410

[56] References Cited

U.S. PATENT DOCUMENTS

| | | | |
|---|---|---|---|
| 2,719,529 | 10/1955 | Wells | 51/426 X |
| 3,160,993 | 12/1964 | McCormick | 51/426 X |
| 4,355,488 | 10/1982 | Schmitz et al. | 51/319 |

*Primary Examiner*—Robert P. Olszewski

*Attorney, Agent, or Firm*—James C. Simmons; E. Eugene Innis

[57] ABSTRACT

A method is provided for overcoming problems heretofore encountered in systems for continuous cryogenic deflashing of molded articles. Such previous problems include the cracking of the articles as a result of thermal shock suffered by spraying the liquefied gas coolant directly on the article to effect embrittlement of the flash and that of blasting media sticking to the articles. The now disclosed system avoids thermal shock by more gradual cooling of the article and by effecting the desired embrittlement by contact with gaseous coolant obtained by vaporization of the liquefied gas within the treating chamber prior to its contact with the articles. The arrangement of the spray nozzles for the coolant is designed to provide an adequate precooling period to avoid thermal shock and to obtain a temperature profile such that insufficient cooling of the mold release wax is avoided.

5 Claims, 6 Drawing Figures

CONTINUOUS DEFLASHING SYSTEM

This application is related to copending applications Ser. No. 445,778 filed Nov. 30, 1982, and Ser. No. 445,648 filed Nov. 30, 1982.

Like the above-cited pending patent applications, the present application is concerned with systems and apparatus for shot blasting of chilled molded articles, for removal of embrittled flash therefrom. It is particularly directed to improvements in certain embodiments of the systems disclosed in said application Ser. No. 445,778.

BACKGROUND OF INVENTION

It is known to remove flash from molded plastic and elastomeric articles by chilling the workpiece to embrittle the flash in order to facilitate its removal by impact with a high velocity stream of solid granular media in the form of shot or pellets.

In a typical operation the piece or pieces to be treated are introduced into a heat-insulated chamber maintained at required low temperature and the stream of blasting media is impelled at high velocity against the surface of each piece by one or more rotating impellers or so-called throwing wheels. The discharged blasting media together with the fragments of the flash thereby removed, are collected and conveyed out of the treating chamber to a screening apparatus in which the blasting media is separated and recovered for recycling to the blasting operation; and the refuse comprising larger fragments of removed material as well as fines are discharged. Several embodiments of such systems are described in the above-cited pending application Ser. No. 445,778, and in the earlier prior art cited in said pending application which disclosure is incorporated herein by reference. The preferred blasting media advocated is pelleted polycarbonate resin.

As indicated in the above-cited pending patent applications and the prior art therein listed, the removal of flash and coatings from articles by blasting of the chilled articles may be carried out by batch or continuous type processes. In the continuous type process, with which the present patent application is more particularly concerned, the material to be treated is moved by a conveyor through an elongated tunnel and during such passage it is subjected to chilling and contact with the blasting media. Systems of the continuous type are described, for example, in U.S. Pat. Nos. 3,824,739 and 4,312,156, and in the embodiments illustrated by FIGS. 6 and 7 of said pending application Ser. No. 445,778.

As described with respect to the continuous mode embodiment in said application Ser. No. 445,778, the articles to be subjected to impact by the blasting media are passed through the treating tunnel on a foraminous endless belt. Liquefied gas, such as liquid nitrogen (LIN) is directed downwardly toward the articles on the moving belt, through spray nozzles located ahead of the first of two throwing wheels mounted on the roof of the tunnel and arranged to impel the blasting media downwardly into contact with such articles.

During initial full-scale production operation of a cryogenic deflashing system wherein liquid nitrogen employed as the chilling medium was sprayed in liquid form directly on the molded articles, several problems were encountered. It was found that in spraying of the cold liquid, particularly on the articles such as padded automobile arm rests, a considerable number of the treated articles were cracked at the surface. Another major problem heretofore encountered was the sticking of blasting media to the undersides of the articles subjected to deflashing, found to be due to the mold release wax present thereon. To remove the sticking media particles it was necessary to employ an additional operator to blow off the media with compressed air.

SUMMARY OF THE INVENTION

In accordance with the present invention, the several problems heretofore encountered in plant scale operation of prior continuous cryogenic deflashing systems are remarkably diminished or substantially eliminated. This is achieved by directing the path of the liquefied gas coolant so that the coolant is evaporated before coming in contact with the workpieces. Also by locating the spray heads at selected positions with respect to the throwing wheel or wheels and providing a path of travel of the workpiece to afford adequate time for more gradual precooling of the workpiece, local thermal shock is avoided, thereby eliminating the chief cause of cracking; and more efficient cooling is achieved, thereby alleviating the problem of media sticking to soft mold release wax on the pieces due to insufficient cooling.

The invention will be understood and its several advantages appreciated from the detailed description which follows read in connection with the accompanying drawings.

DETAILED DESCRIPTION

Figure 1:
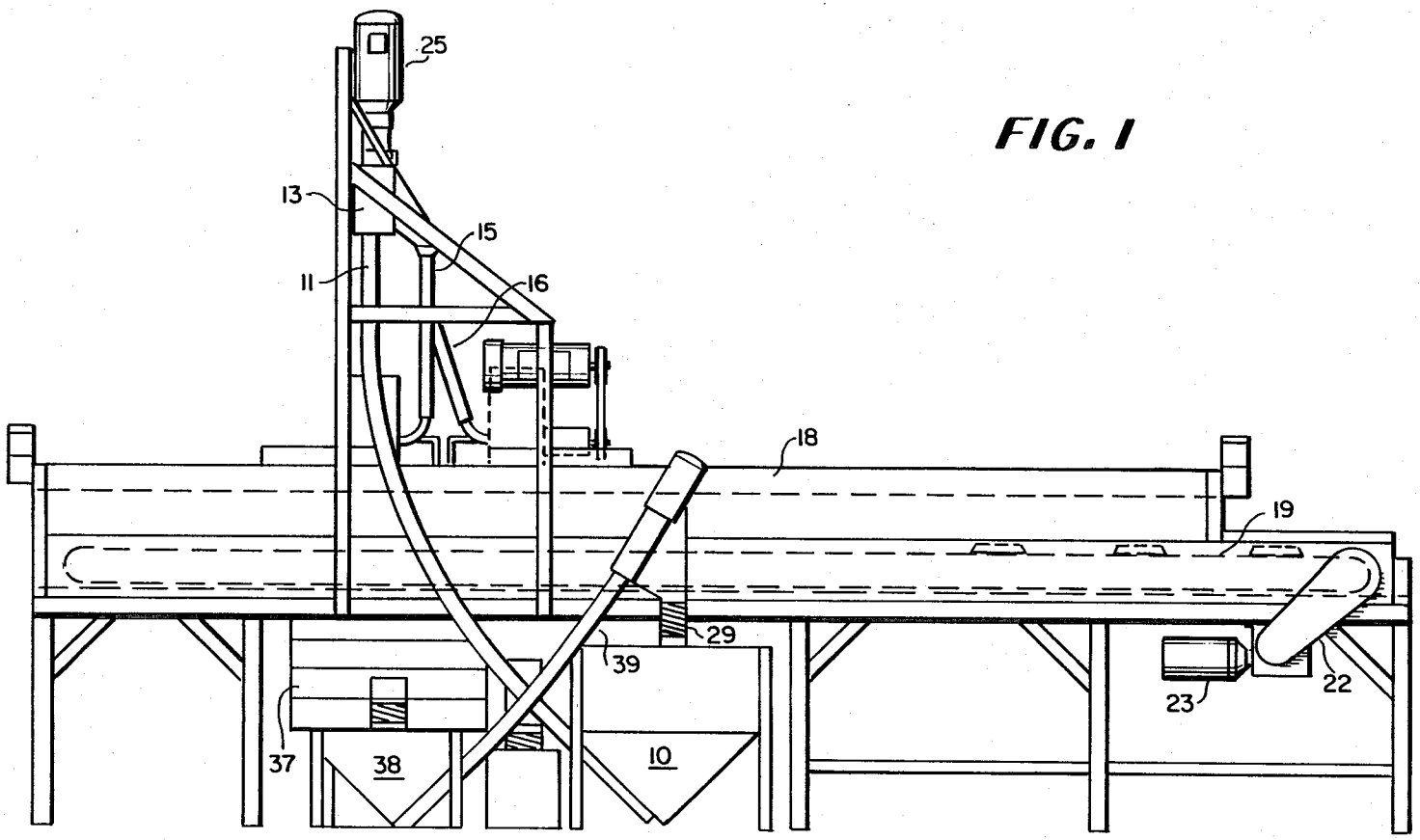
FIG. 1 is a side view of apparatus useful in practice of the invention.
Figure 6:
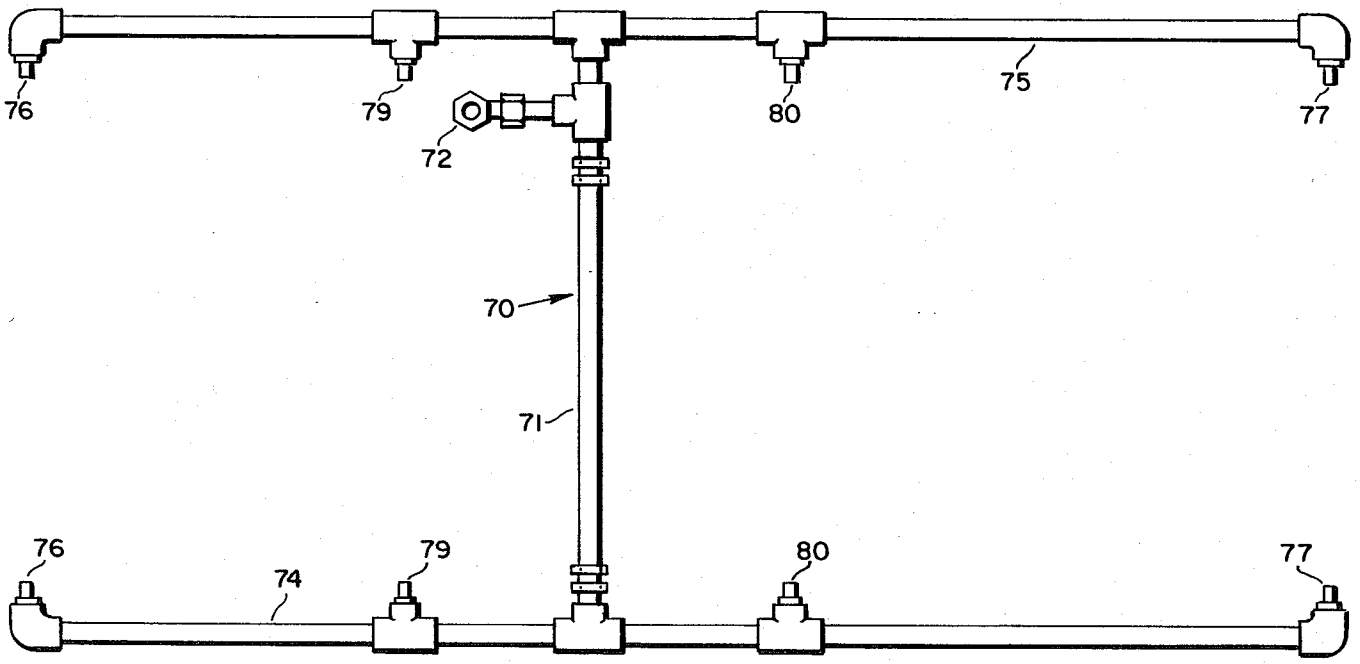
FIG. 6 is a detailed plan view of the spray header assembly for directing coolant into the tunnel.

The overall operation is largely similar to that described with respect to the embodiments illustrated in FIGS. 6 and 7 of copending application Ser. No. 445,778. As shown in FIG. 1 of the present drawings, screened and clean blasting media contained in storage hopper 10 is withdrawn therefrom by a pair of flexible screw conveyors 11 and transported upwardly thereby to a transfer level 13 at which the conveyed media is discharged into gravity chutes for supply to the throwing wheel or wheels. In the illustrated embodiment, the media discharged at the outlets of conveyors 11 drops into two such chutes or tubes 15 and 16, each feeding a separate throwing wheel mounted on the roof 18 of the treating tunnel, through which tunnel a foraminous endless belt conveyor 19 is passed. The upper and lower runs of belt 19 are each supported, at least during passage through the tunnel, above an underlying blanket or plate 20 (FIG. 2).

Belt 19 is driven at one end by a power transmission means 22, such as a gearing or pulley arrangement suitably connected to the driven shaft of motor 23. Screw conveyor 11 is driven by motor 25, which is preferably provided with means for varying and setting the speed of conveyor 11. If so desired, transmission means 22 may also be provided with means for varying and setting the speed of conveyor 19.

The throwing wheels mounted respectively within insulated housings 30 and 31 are separately driven by similar individual power sources, one of which is shown at 32, operating through suitable transmission mechanism such as belts and pulley 33, 34 and 35 to rotate the respective shafts of the throwing wheels journaled in bearings 36.

Figure 2:
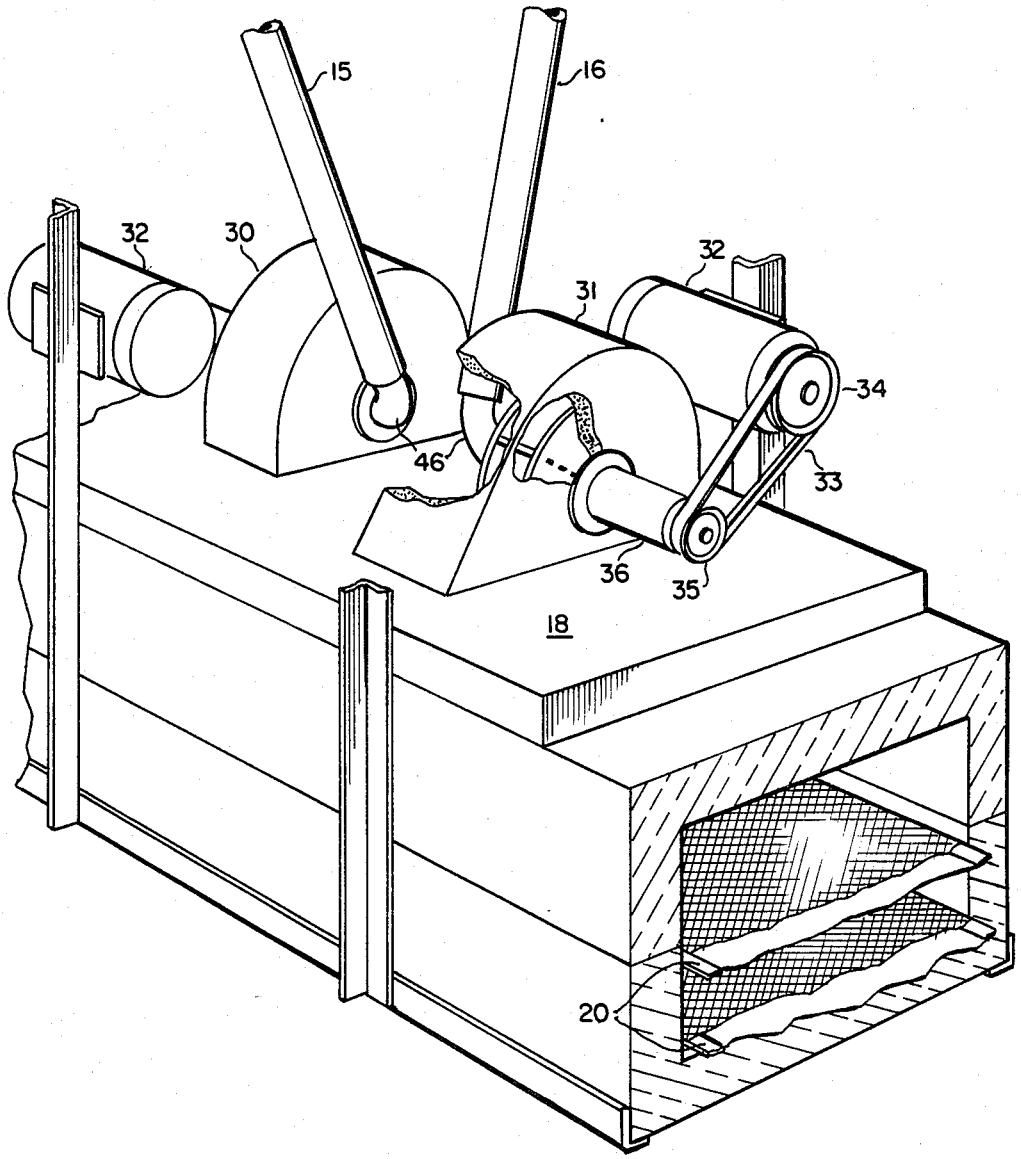
FIG. 2 is an enlarged partial isometric view of the apparatus of FIG. 1.

As seen more particularly in FIG. 2, tube 15 supplies clean blasting media to the center of the throwing wheel mounted for rotation within housing 30, while tube 16, similarly, supplies such media to the center of the wheel mounted within housing 31, in the usual manner known to the art.

Figure 3:
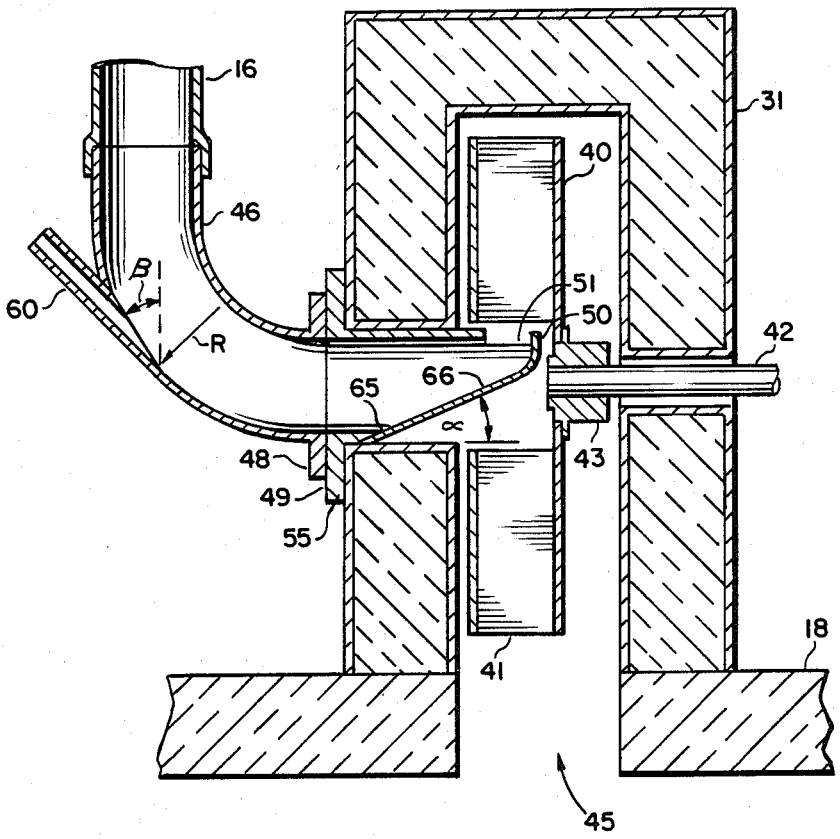
FIG. 3 is a further enlarged partial view in vertical section showing details of a preferred means for feeding impact media into a throwing wheel.

In the preferred arrangement as illustrated in FIG. 3, the throwing wheel 40, mounted in housing 31, includes a number of radial vanes or blades 41, and is rotated by a drive shaft 42 journaled in bearing 36 (FIG. 2), the drive shaft being fixedly connected to the hub 43 of the wheel.

The blades or vanes 41 are spaced radially outwardly from the center of the wheel to provide a central area adjacent the inner ends of the blades, into which area the blasting media is charged. By rotation of the wheel at sufficient velocity, the media is centrifugally impelled into the treating tunnel through an opening 45 in the roof thereof, and into contact with workpieces carried on belt 19.

The clean blasting media is similarly fed to the wheels from chutes 15 and 16, respectively. Thus, chute 16 terminates in an integral or joined elbow piece 46, which provides a transition zone in which the media gravitating from cute 16 changes direction of movement from the downward free fall path to a laterally oriented path directed toward the central area of the throwing wheel. To transport the media along this lateral path and into the wheel, gas is injected into the elbow or transition zone in the manner hereinafter described.

The used blasting media after contact with the workpieces on the belt, together with fragments of material removed from the workpieces by such contact, fall as a mixture toward the floor of the tunnel. This mixture is passed by suitable means (not shown) from the floor of the tunnel to the screening device 37, wherein the reusable media is separated out from the refuse, and is collected in hopper 38. The clean reclaimed media is picked up from hopper 38 by screw conveyor 39 and conveyed to a discharge level above storage hopper 10. At the discharge level, the media is dropped via chute 29 into hopper 10, from which it is withdrawn for reuse as already described.

The particular preferred manner of introducing the blasting media into the throwing wheels will now be described. Elbow 46 is provided with a peripheral flange 48 by which it is removably attached to flanged tubular discharge spout 49, which in turn is attached to a side wall of the wheel housing. The horizontal center line of spout 49 is coaxial with the axis of rotation of the throwing wheel. The forward end of spout 49, which lies within the central area of the throwing wheel, is closed by an end wall 50. Adjacent end wall 50, a discharge slot or opening 51 is provided in the periphery of the spout, through which opening media is radially discharged into the spaces between the blades 41 of the wheel. By loosening the bolts attaching flange 48 of elbow 46 and the companion flange 55 of spout 49 to the wheel housing 31, the circumferential position of slot 51 can be oriented as desired to set the discharge pattern of the media being hurled into the treating tunnel, as is known in the prior art.

The manner in which the transporting gas is introduced to move the media through the disposed path and into the throwing wheel via spout 49 is of critical importance in avoiding the buildup of a stagnant mass or clumps of mold release wax and media in the vicinity at which the media falling from the downwardly directed supply chute enters the laterally directed feed conduits.

As shown in FIG. 3, the gas injection line 60 is directed downwardly at an angle to elbow 46 and through the outer wall of the arc joining the vertical and horizontal segments of the elbow. The initial direction of the gas stream as it leaves the discharge opening of line 60 is along a line tangent to the outer peripheral wall of elbow 46, said line being at an angle $\beta$, which may be in the range of about 30 to 60 degrees to the vertical, with a preferred angle of about 45°, as shown in FIG. 3.

In this manner, the media smoothly rounds the bend in the elbow without holdup and is moved by the injected gas into and through spout 49 and thereby projected into the throwing wheel. Air, gaseous nitrogen or any other nonreactive gas, compressed to a pressure of at least 15 psig, may be employed in line 60.

To further assure against clogging and jamming of the media flow by accumulation of material adhering to the inner wall in the vicinity of the bend in the elbow, the internal surface of the wall is coated with a low friction material, such as Teflon ® polyfluorocarbons.

Smooth flow of the media through spout 49 into the center of the throwing wheel is augmented by the illustrated construction. As shown, the bottom wall of spout 49 is cut off at a taper at an angle $\alpha$, which may be in the range of about 16° to 30° to the horizontal, with a recommended preferred angle of about 23° at a point 65, a short distance from flange 55 and extending to the distal end of spout 49. The cut-off bottom of the spout is replaced by a template 66 having a flat planar surface extending at angle $\alpha$ to the horizontal from point 65 and then curving upwardly adjacent hub 43 to blend smoothly with a continued portion at a right angle to the horizontal to provide end wall 50.

The specific construction of the means and mode for introducing the blasting media into the throwing wheel as illustrated in FIG. 3 is not claimed as part of the present invention, but is described and claimed in pending patent application Ser. No. 445,648.

The present invention, as hereinbefore indicated, is particularly concerned with the manner of chilling the molded workpieces, to effect the desired extent of embrittlement for deflashing by impact with the blasting media. In previous systems, the liquefied gas, such as LIN, was sprayed as liquid directly onto the workpieces. In a typical prior art arrangement, for example, the direct contact LIN spray in a continuous deflashing system was located about two feet ahead of the first of two throwing wheels spaced along the path of travel of the workpiece through the treating tunnel. The spray nozzles in such direct liquid spray operation in a typical system are arranged in a number of spaced-apart rows above the conveyor belt, each row having several spray nozzles across the width of the conveyor belt. The first row of spray nozzles was positioned at a location from the tunnel entrance spaced at about ⅓ of the length of the tunnel. By contact of the very cold sprayed liquid with the workpiece, evaporation of the liquid produced nitrogen gas, a portion of which flowed toward the inlet end of the tunnel. An incoming workpiece, thus, underwent a relatively short precooling by counter-current contact with the exiting gas, before being brought into initial contact with the liquid coolant spray at about −320° F. (−196° C.). As a result of such sudden exposure of the relatively warm workpiece to such low temperature, the molded article likely undergoes a thermal shock, which may explain the observed cracking of a number of the molded plastic pieces or weakening of the structure such that cracking takes place on contact with the high velocity stream of blasting media. As the workpiece passes the last row of liquid spray heads and travels past the first of the two throwing wheels towards the second, the workpiece is rewarmed such that on reaching the vicinity of the second wheel and beyond the vicinity, the workpiece may be at a temperature at which some of the mold release wax thereon is softened to an extent permitting adherence of particles of granular media thereto . A typical temperature profile of a treating tunnel for continuous cryogenic deflashing of molded articles, utilizing a series of nozzles for spraying liquid nitrogen directly on the articles is shown by line graph A in FIG. 5. It will be seen that the temperature profile along the length of the tunnel undergoes extreme gradients.

Figure 4:
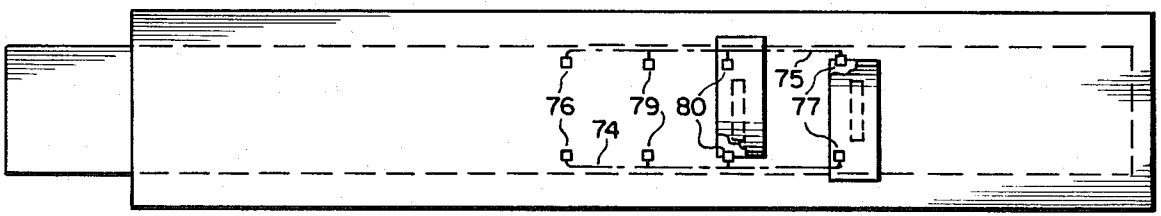
FIG. 4 is a schematic top plan view of the apparatus shown in FIG. 1, showing the location of the coolant spray nozzles along the path of travel of the articles through the apparatus.

By operation in accordance with the present invention, the damaging effects of exposure of the molded articles to extreme temperature gradients, is avoided. Thus, as shown in FIGS. 4 and 6, the LIN spraying arrangement, in accordance with the present invention, employs a spray header assembly 70 arranged at a level above the conveyor belt 11, and comprising a plurality of spray nozzles adjacent opposite edges of the belt, oriented to direct the spray of liquefied gas transversely across the belt and substantially parallel to the belt surface. In this manner articles conveyed on the belt are not directly contacted by the liquefied gas but are chilled by the cold gas in the tunnel resulting from evaporation of the sprayed liquid.

Thus, in the embodiment illustrated in FIGS. 4 and 6, spray header assembly 70 comprises manifold 71 into which LIN is introduced through inlet 72. Manifold 71 extends tranversely across the belt and at its opposite edges is attached in liquid flow communication to distributing tubes 74 and 75 longitudinal to the belt and approximate the lateral edges thereof. Each of tubes 74 and 75 is provided with a plurality of spray nozzles oriented to direct the spray of LIN transversely across the belt and substantially parallel to the belt surface. In the illustrated arrangement each of tubes 74 and 75 is provided with a first spray nozzle 76 at the end of the distribution tube nearest the tunnel entrance, and spray nozzle 77 at the other end of each tube. Additional spray nozzles are provided at intermediate positions along the length of tubes 74 and 75. As shown in the illustrated embodiment, two intermediate nozzles 79 and 80 are arranged along the length of tubes 74 and 75.

The location of the spray header assembly and the spacing of the spray nozzles are designed to provide adequate and gradual precooling of the workpieces before being subjected to bombardment by the media at each of the throwing wheel locations. Also, the relative size of the orifice in each of the spray heads is selected to provide a biased positive flow of most of the coolant gas towards the entrance of the tunnel, thus effecting a countercurrent heat exchange with the warm incoming workpieces over a path of sufficient length to assure a residence time adequate for desired precooling. Spray nozzles 80 are located in the area immediately adjacent to or within the first blasting zone and spray nozzles 77 are similarly located with respect to the second blasting zone.

Figure 5:
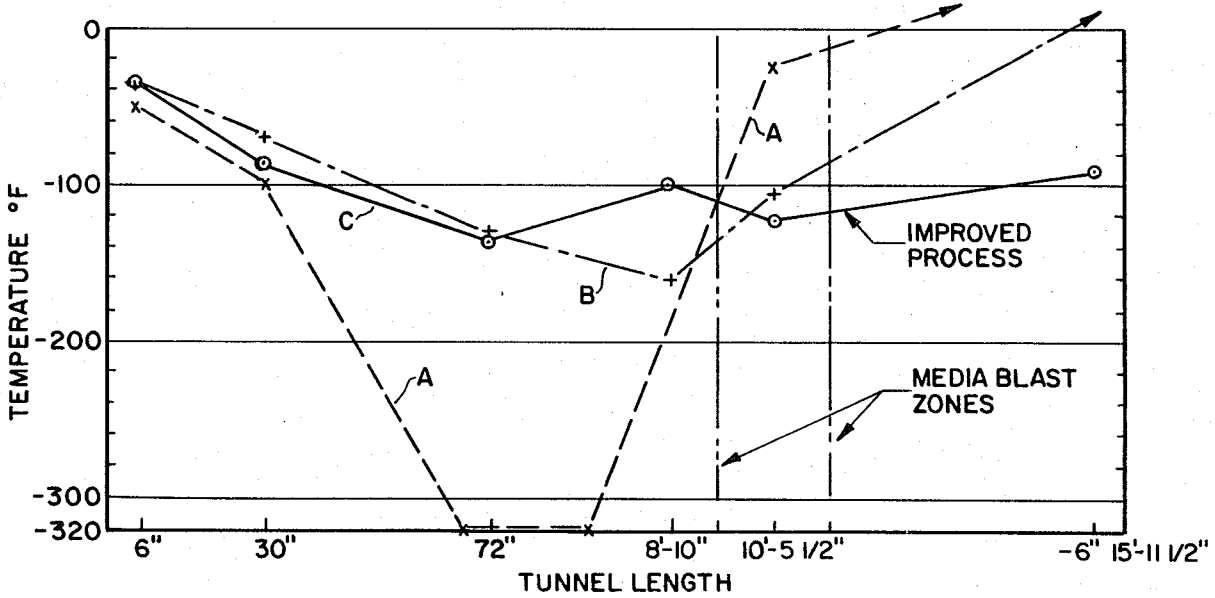
FIG. 5 is a plot of the temperature profiles along the travel path of the articles by the operation in accordance with the invention, as compared to prior operation.

In FIG. 5, the temperature profile within the tunnel is depicted by line graph B, measured during an initial period in which the downwardly directed liquid spray was initially modified in accordance with the invention and replaced by the coolant spray arrangement of FIGS. 4 and 6. It will be noted that the extremes in temperature gradient that had existed in the earlier direct liquid spray arrangement, as shown in line graph A, have been avoided. As shown by line A, the temperature in the tunnel drops rather rapidly from about −46° F. (−43° C.) near the tunnel entrance to −320° F. (−195° C.) and again rapidly reaches a temperature in the order of about −25° F. (−20° C.) at a point between the two throwing wheels. In contrast thereto, as shown by line B, the lowest temperature measured in the tunnel by an arrangement of sprays in accordance with the invention is at about −160° F. (−107° C.) adjacent the first throwing wheel, remaining below −85° F. (−65° C.) in the vicinity of the second throwing wheel.

The temperature profile depicted by lines A and B of FIG. 5 represent conditions prevailing during operation of a commercial plant installation in continuous deflashing of padded plastic articles. The cryogenic deflashing of such articles under conditions such as depicted by line A, presented severe problems resulting from the previous practice of spraying LIN directly on the articles, wherein in the order of about 5% of the articles came out cracked at the surface and many of the articles had to be manually operated upon to remove adhering particles of blasting media. In some instances, also, deflashing was incomplete and required the use of an operation for additional hand trimming. When the installation was modified to reposiion and reorient the LIN spray nozzles to direct the spray stream in a direction tranversely across the belt and at a height such that the sprayed liquid was evaporated before contact with the articles, it was found that the problems theretofore encountered were entirely eliminated.

To obtain further improvement in operation and smaller deviation in temperature along the length of the tunnel, the several spray nozzles were adjusted to vary their discharge rates. The total discharge area of the spray nozzle orifices was increased by about 50 to 60%, preferably about 54%. The sizes of the orifices are so arranged that 10 to 20%, preferably 15% of the LIN sprayed into the tunnel is supplied by the first row of nozzles (76), and by the second row of nozzles (79), respectively, 25 to 35%, preferably 30% by the nozzles (80) immediately adjacent the first throwing wheel and 35 to 45%, preferably 40% of the LIN by the nozzles (77) immediately adjacent the second throwing wheel. The obtained temperature profile measured in the tunnel was based on the preferred arrangement of orifice sizes set forth above and is shown by line C in FIG. 6.

The cryogenic deflashing unit in which the operations represented by the temperature profiles depicted in FIG. 5, except for the arrangement of the coolant spray nozzles, was the same in each instance. It comprised an insulated treating tunnel of approximately 16 feet (4.88 m.) in length, having two throwing wheels mounted on the roof of the tunnel, the first of the wheels being at a distance of about 9½ feet (2.9 m.) and the second at a distance of about 11⅜ feet (3.47 m.) from the tunnel entrance. The flow of liquid nitrogen to the spray header was regulated by a valve actuated by a temperature controller arrangement including a thermocouple within the tunnel.

The new spray header illustrated in FIGS. 4 and 6 was installed in the unit at a height of approximately 7¼ inches (18.4 cm.) above the belt. To create the desired gas flow for precooling the workpieces larger size nozzles were placed in the two throwing wheel areas (nozzles 77 and 80) and smaller nozzles (76 and 79) placed ahead of the throwing wheels. The LIN nozzles were installed adjacent the throwing wheels on the side toward the tunnel entrance so that the pressure drop created by the throwing wheels induced flow toward the entrance. The temperature profile depicted in line B indicates that this desired effect was obtained. The temperature between the throwing wheels averaged about −120° F. (−84° C.). The temperature at the tunnel entrance was about −31° F. (−35° C.) and the discharge temperature was −90° F. (−68° C.).

After installation of the new spray header which converted the previous direct liquid spray of LIN on the workpieces to that employing "gas only" cooling, the results exceeded expectations. Flash removal was considerably improved so that even relatively thick flash was now being removed. The previous problems of cracking of the articles and media sticking to the underside were overcome.

EXAMPLE 1

A trial run of a continuous system for deflashing of molded articles in accordance with the invention was carried out in a commercial plant with the following operating parameters, employing two throwing wheels in series mounted on the roof of the tunnel and liquid nitrogen horizontally sprayed parallel to the belt from a location of 7.25 inches (18.41 cm.) above the conveyor belt so that the articles on the belt were not contacted with liquid spray.

The operating parameters employed were as follows:

| | |
|---|---|
| Media feed rate | 34.4 lbs/min (15.6 kg/min.) |
| Throwing wheel speeds | 4000 rpm |
| Conveyor belt speed | 5.8 ft./min. (1.77 m/min.) |
| Residence in Tunnel | 2.75 min. |
| Temperature setpoint | −160°F. (−107° C.) |

The orifice sizes in each of the LIN nozzles are tabulated below:

| | |
|---|---|
| 76 | 0.078 in. (0.198 cm.) |
| 79 | 0.094 in. (0.239 cm.) |
| 80 | 0.109 in. (0.277 cm.) |
| 77 | 0.109 in. (0.277 cm.) |

The average temperature profiles are reported in Table 1:

TABLE 1

| | °F. | (°C.) |
|---|---|---|
| Tunnel entrance | −33.6 | (−36) |
| 30 inches from tunnel entrance travel time | −69.0 | (−56) |
| 72 inches from tunnel entrance travel time | −129.6 | (−90) |
| Between throwing wheels | −104.3 | (−76) |
| At tunnel discharge | +19.2 | ( −7) |

By providing cooling of the articles within the blasting zone area with the resulting low temperature in that zone, superior flashing was had as compared with the earlier cooling system arrangement. The relatively warm temperature at the tunnel entrance indicates that gradual counter-current cooling of the workpieces is achieved. The discharge temperature of 19° F. (−7° C.) shows that nitrogen was being carried over into this area. Such flow of part of the nitrogen toward the tunnel exit is highly desirable so that outside air does not become entrained in the tunnel, which could cause frosting and media sticking problems.

In addition to improved flash removal attained, including the clean removal of even relatively thick flash, the two major problems of prior operation were successfully overcome. Because the articles treated were sufficiently cold in the blasting area and beyond, the media was not sticking to the underside of the article and the need for hand removal of media was obviated. Also the cracking of the treated articles, heretofore experienced, was entirely eliminated in that no cracked articles were produced during the operation of the trial run. Nitrogen consumption was within expected limits.

EXAMPLE 2

The same system as employed in Example 1 was employed in the test run, except that the flow capacity of the spray nozzles was increased by 54% as hereinbefore indicated, so that the first and second rows of nozzles each supplied 15% of the LIN coolant, the third row (adjacent the first throwing wheel) 30% and the last row (adjacent the second throwing wheel) 40%.

The operating parameters employed were as follows:

| | |
|---|---|
| Throwing wheel speeds | 4000 rpm |
| Media feed rate | 34.4 lbs/min. (15.6 kg/min.) |
| Conveyor belt speed | 5.8 ft./min. (1.77 m/min.) |
| Retention time | 2.75 min. |
| Temperature setpoint | −100° F. (−73° C.) |

The quality of the deflashing was excellent including the removal of flash having a thickness of 0.02 (0.05 cm.) to 0.035 inches (0.09 cm.). The extent of touch-up trimming of flash heretofore required was largely reduced. There were no cracked articles resulting from thermal shock. Nitrogen consumption remained low. The foregoing parameters represent the preferred embodiment of the invention.

What is claimed is:

1. In the pellet blasting of molded articles for removal of embrittled flash therefrom, wherein said articles are contacted with a high velocity stream of blasting media while said articles are being continuously conveyed on the upper surface of an endless belt in a longitudinal travel path through a chilling tunnel from an article entrance end to an article discharge end of said tunnel, the improved operating method which comprises:

spraying liquefied gas coolant into said tunnel at a plurality of locations along the travel path of said articles within the tunnel, directing the liquefied gas spray from opposed directions tranversely of the travel path from an elevated position sufficiently above the conveyed articles such that the sprayed liquefied gas is evaporated before any of the liquefied gas spray contacts the articles in liquid form, and setting the relative quantity of liquefied gas spray at each of said plurality of locations selectively to provide a biased positive flow of most of the evaporated coolant towards the article entrance end of the tunnel to effect gradual cooling of articles introduced at said entrance end.

2. The method as defined in claim 1 wherein a plurality of blasting media streams in series are employed for blasting of said articles and said spraying of liquid coolant is at locations adjacent each of said streams of blasting media.

3. The method as defined in claim 1 wherein said spraying of liquefied gas coolant is effected at one or more locations between the article entrance end of the tunnel and a region in which the conveyed articles are first contacted with blasting media.

4. The method as defined in claim 3 wherein a plurality of blasting media streams in series are employed for blasting of said articles and said spraying of liquefied gas coolant is at locations adjacent each of said streams of blasting media and also at a plurality of locations between the article entrance end of said tunnel and the region in which the conveyed articles are first contacted with blasting media.

5. The method as defined in claim 2 wherein said biased positive flow of most of the evaporated coolant towards the article entrance end of said tunnel is promoted by selective positioning of the plurality of spraying locations along the longitudinal travel path, one of said locations being adjacent to but in advance of the region in which the conveyed articles are first contacted with blasting media.

* * * * *